United States Patent [19]

Gaule et al.

[11] 4,265,294

[45] May 5, 1981

[54] DUFLEX IMPEDANCE SHIELD FOR SHAPE CONTROL IN ELECTROMAGNETIC CASTING

[75] Inventors: Gerhart K. Gaule, Elberon, N.J.; John C. Yarwood, Madison, Conn.; Derek E. Tyler, Cheshire, Conn.; Ik Y. Yun, Orange, Conn.

[73] Assignee: Olin Corporation, New Haven, Conn.

[21] Appl. No.: 43,726

[22] Filed: May 30, 1979

[51] Int. Cl.[3] ..... B22D 27/02; B22D 11/01

[52] U.S. Cl. ..... 164/49; 164/147

[58] Field of Search ..... 164/49, 147, 250, 251

[56] References Cited

U.S. PATENT DOCUMENTS

| | | | |
|---|---|---|---|
| 3,467,166 | 9/1969 | Getselev et al. | 164/147 |
| 3,605,865 | 9/1971 | Getselev | 164/147 |
| 3,646,988 | 3/1972 | Getselev | 164/251 |
| 3,735,799 | 5/1973 | Karlson | 164/147 |
| 3,741,280 | 6/1973 | Kozhevrov et al. | 164/49 X |
| 3,773,101 | 11/1973 | Getselev | 164/251 |
| 3,985,179 | 10/1976 | Goodrich et al. | 164/49 X |
| 4,004,631 | 1/1977 | Goodrich et al. | 164/250 |
| 4,135,568 | 1/1979 | Brooks | 164/147 |
| 4,161,206 | 7/1979 | Yarwood et al. | 164/251 |

*Primary Examiner*—Robert D. Baldwin
*Assistant Examiner*—Gus T. Hampilos
*Attorney, Agent, or Firm*—Victor A. DiPalma; Paul Weinstein

[57] ABSTRACT

A duplex impedance shield is disclosed which is used to effect improved shape control in the electromagnetic casting of molten metal or alloy. The shield is provided with a primary loop which substantially surrounds the upper portion of an electromagnetic casting station and a secondary loop attached thereto which serves to enlarge the air gap enclosed by the shield thereby increasing the impedance of the shield. The secondary loop of the shield may be provided with shunt means which can be manipulated to vary the inductance and/or the resistance of the shield thereby varying the impedance of the shield.

39 Claims, 8 Drawing Figures

DUFLEX IMPEDANCE SHIELD FOR SHAPE CONTROL IN ELECTROMAGNETIC CASTING

BACKGROUND OF THE INVENTION

This invention relates to an improved duplex impedance shield for shape control in electromagnetic casting of metals and alloys. The invention also relates to a variable impedance duplex shield which may be readily adjusted before or during an electromagnetic casting run. Electromagnetic casting of metals and alloys has been known and used for many years.

PRIOR ART STATEMENT

Known electromagnetic casting apparatus comprises a three part mold consisting of a water cooled inductor, a non-magnetic screen, and a manifold for applying cooling water to a forming ingot. Such an apparatus is exemplified in U.S. Pat. No. 3,467,166 to Getselev et al. Containment of the molten metal is achieved without direct contact between the molten metal and any component of the mold. Solidification of the molten metal is achieved by direct application of water from the cooling manifold to the ingot shell.

The prior art in electromagnetic containment and casting of molten metal generally discloses the use of an alternating magnetic field of an inductor to provide a means of inducing electromagnetic pressure within and containing molten metal. The electromagnetic pressure affected in the prior art is controlled to counterbalance the variable metallostatic pressure through the use of non-magnetic shields or screens, such as those exemplified by U.S. Pat. Nos. 3,646,988, 3,773,101, 3,605,865, 3,985,179, 3,467,166, 3,741,280, 4,004,031, 3,702,155, and 3,735,799. These shields act to attenuate the magnetic field generated by the primary inductor in such a way as to maintain vertical or near vertical side walls in the liquid, especially in the vicinity of the solid-liquid interface. These shields are normally positioned above the liquid-solid interface and between the inductor and the molten metal. Currents are induced within the shield to an extent which depends on the shield's electrical impedance and the shield itself can be considered as a counter inductor.

The aforenoted prior art discloses various arrangements between the inductor and the shield to effect the required shape control and permit control of ingot solidification in this process. For example, it is known to design the shield to have increasing thickness in a vertical, upwards direction so as to shield more effectively at a greater height above the liquid-solid interface. In addition, it is known to move the shield in a vertical plane, thus providing a variable inductance and permitting fine control of ingot shape, particularly adjacent to the molten metal meniscus. (See U.S. Pat. No. 3,605,865).

One drawback of the shield shape control of U.S. Pat. No. 3,605,865 is that movement of the shield during casting has a detrimental effect on ingot solidification, particularly when the shield is used to deflect the water cooling stream onto the solidifying ingot surface, since movement of the shield results in movement of the coolant impact location and a corresponding movement of the liquid-solid interface.

Another type of shield is depicted in U.S. Pat. No. 4,135,568 which shows a shield for use in electromagnetic casting comprised of segmental strips arranged to form a tubular shaped segmented shield structure.

With respect to materials of construction for screens, Getselev U.S. Pat. No. 3,605,865 teaches that materials of construction are frequency dependent. Copper or aluminum is disclosed as usable at frequencies of 50 to 500 Hz and non-magnetic steel at frequencies from 1000 to 2500 Hz.

The present invention overcomes the deficiencies described above and provides highly desirable means for varying the impedance of a non-magnetic shield used to provide ingot shape control in electromagnetic casting of metals and alloys.

SUMMARY OF THE INVENTION

This invention relates to duplex and variable duplex impedance shields for shape control in electromagnetic casting of metals and alloys. In particular, a shield having primary and secondary loops is utilized to attenuate the magnetic field generated by the inductor of the electromagnetic casting apparatus in such a way as to maintain vertical or near vertical sidewalls in the liquid metal or alloy.

In accordance with one aspect of this invention an improved duplex impedance shield is provided wherein the shield comprises a primary loop which is positioned between the molten metal or alloy being cast and the electromagnetic inductor and a secondary loop attached thereto which is positioned outside the electromagnetic casting zone. Provision of such a secondary loop permits attainment of greater impedance values for the shield while maintaining a standard cross-section shield portion adjacent the casting station. The provision of such a secondary loop also enables the use of certain desirable materials, e.g. copper and aluminum for the material of the shield where previously such materials could not be effectively utilized at typical electromagnetic casting frequencies.

In accordance with another aspect of this invention an improved variable duplex impedance shield is provided wherein the secondary loop of the shield and auxiliary portions thereof can be shunted so as to vary the overall impedance of the shield without altering either the position or the shape of the primary shield loop vis a vis the ingot being cast.

In accordance with one preferred embodiment a shunt bar is adjustably mounted across two legs of the secondary loop of the shield to enable slidable adjustment of the overall impedance of the shield.

In accordance with a second preferred embodiment a plurality of shunt lines are provided spanning two legs of the secondary loop of the shield. The shunt lines are provided with electrical switches which can be selectively opened or closed to adjust the impedance of the shield.

In accordance with another embodiment of this invention a plurality of resistors or reactive coils are arranged in series about the secondary loop of the shield. Individual shunt switches are provided across each resistor or reactive coil so as to make it possible to bypass selected resistors or reactive coils thereby adjusting the impedance of the shield as desired.

In accordance with yet another embodiment of this invention a plurality of auxiliary loops are arranged in series about the secondary loop of the shield. Shunt switches are provided across each auxiliary loop so as to make it possible to bypass selected auxiliary loops thereby adjusting the impedance of the shield as desired.

Accordingly, it is an object of this invention to provide an improved process and apparatus for electromagnetically casting metals and alloys.

It is another object of this invention to provide an improved shield for attenuating the magnetic field generated by the inductor in an electromagnetic casting apparatus and process.

It is a further object of this invention to provide means for enlarging and/or varying the impedance of a non-magnetic shield to provide ingot shape control in an electromagnetic casting process without having to alter either the geometry or position of the primary shield loop located adjacent to and in surrounding relation with the electromagnetic casting station of the electromagnetic casting apparatus.

These and other objects will become more apparent from the following description and drawings.

DETAILED DESCRIPTION OF THE PREFERRED EMBODIMENTS

Figure 1:
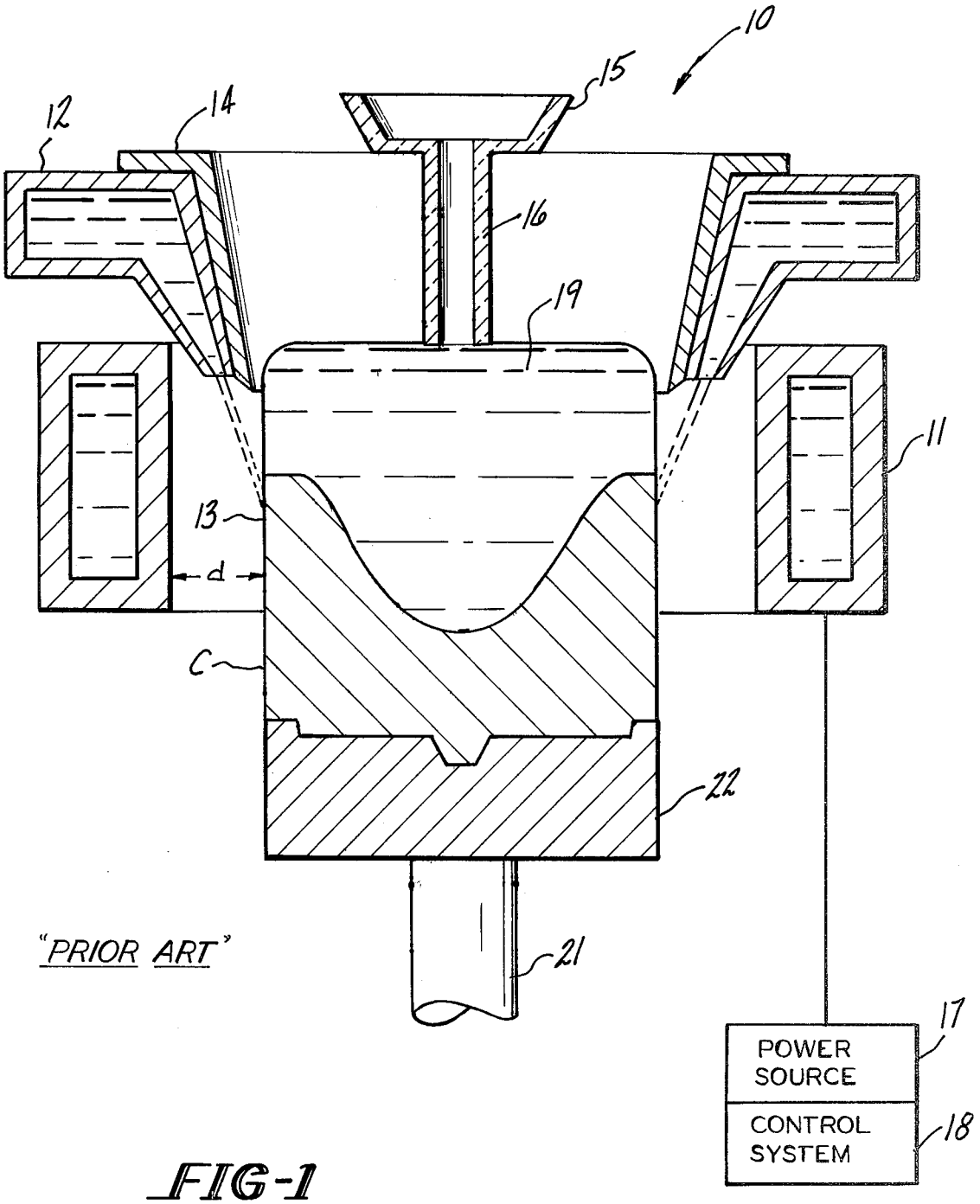
FIG. 1 is a schematic representation of a prior art electromagnetic casting apparatus.

Referring now to FIG. 1 there is shown therein a prior art electromagnetic casting apparatus. The electromagnetic casting mold 10 is comprised of an inductor 11 which is water cooled; a cooling manifold 12 for applying cooling water to the peripheral surface 13 of the metal being cast C; and a non-magnetic shield 14. Molten metal is continuously introduced into the mold 10 during a casting run using a trough 15 and a downspout 16 and conventional molten metal head control. The inductor 11 is excited by an alternating current from a power source 17 and control system 18.

The alternating current in the inductor 11 produces a magnetic field which interacts with the molten metal head 19 to produce eddy currents therein. These eddy currents in turn interact with the magnetic field and produce forces which apply a magnetic pressure to the molten metal head 19 to contain it so that it solidifies in a desired ingot cross section.

An air gap d exists during casting, between the molten metal head 19 and the inductor 11. The molten metal head 19 is formed or molded into the same general shape as the inductor 11 thereby providing the desired ingot cross section. The inductor may have any desired shape including circular or rectangular as required to obtain the desired ingot C cross section.

The purpose of the non-magnetic shield 14 is to fine tune and balance the magnetic pressure with the hydrostatic pressure of the molten metal head 19. The non-magnetic shield 14 may comprise a separate element as shown or may, if desired, by incorporated as a unitary part of the manifold for applying the coolant.

Initially, a conventional ram 21 and bottom block 22 is held in the magnetic containment zone of the mold 10 to allow the molten metal to be poured into the mold at the start of the casting run. The ram 21 and bottom block 22 are than uniformly withdrawn at a desired casting rate.

Solidification of the molten metal which is magnetically contained in the mold 10 is achieved by direct application of water from the cooling manifold 12 to the ingot surface 13. In the prior art embodiment shown in FIG. 1 the water is applied to the ingot surface 13 within the confines of the inductor 11. The water normally may be applied to the ingot surface 13 above, within or below the inductor 11 as desired.

The present invention is concerned with controlling the inductance of the shield in an electromagnetic casting apparatus without moving the shield in relation to the inductor and without changing shields. The present invention is also concerned with providing a shield geometry which will permit use of low resistivity materials such as copper or aluminum at frequencies higher than heretofore found practicable during electromagnetic casting runs. Provision of impedance value control and utilization of materials such as copper and aluminum during typical electromagnetic casting frequencies is accomplished in accordance with the present invention by utilizing a shield provided with both primary and secondary sections and by utilizing such a shield so that only the primary section is located adjacent the electromagnetic casting zone.

As described in the prior art non-magnetic shields are normally of fixed geometry and are positioned above the liquid-solid interface between the primary inductor and the molten metal and act to attenuate the magnetic field generated by the primary inductor. Currents are induced within the shield to an extent which depends on the shield's electrical impedance. Such currents shield and attenuate the field at the molten metal surface.

The impedance of the shield reflects both its inductance and resistance. The inductance depends on the air gaps between inductor and shield and the shield ingot; resistance depends on the geometry and resistivity of the shield.

At a particular frequency (f) impedance (Z) is defined by the equation:

$$Z = \sqrt{R^2 + X^2}$$

where

X is the reactance and equals $2\pi fL$

R is the resistance of the shield

L is the inductance

As indicated by the above formulae as the inductance (L) is varied at a particular frequency (X) is varied one to one. Since (X) is typically greater than (R) by an order of magnitude the system can be described as reactive rather than resistive. Accordingly it is preferable to adjust the impedance (Z) by altering the inductance (L) rather than the resistance (R), and this is readily accomplished by altering the air gap enclosed by shield 30.

Figure 2:
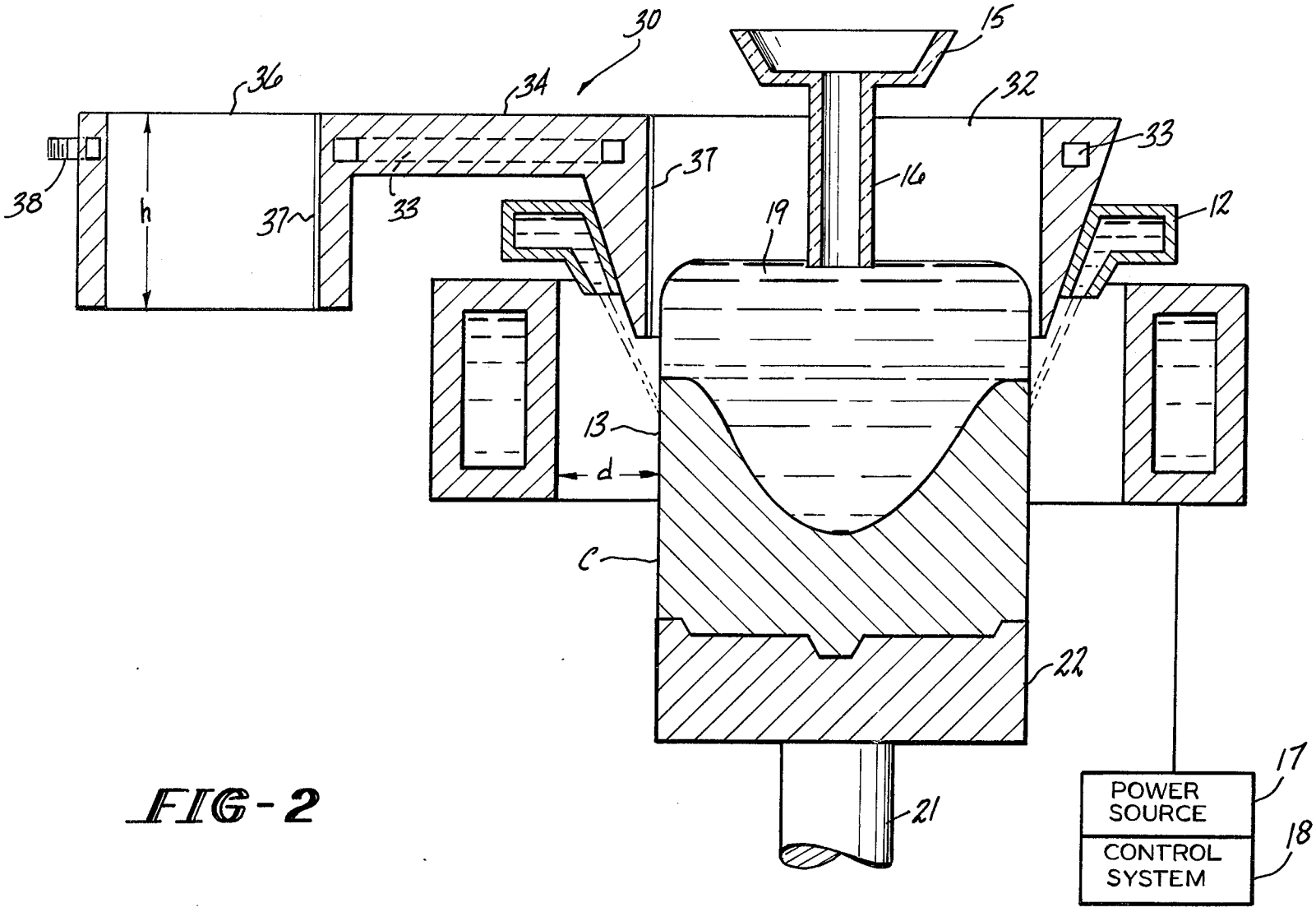
FIG. 2 is a schematic representation of an electromagnetic casting apparatus showing primary and secondary sections of a duplex impedance shield in accordance with this invention.

Referring now to FIG. 2 there is shown therein a schematic representation of an electromagnetic casting apparatus similar to the prior art electromagnetic casting apparatus depicted in FIG. 1, showing a duplex impedance shield 30 in accordance with this invention in place of prior art shield 14. Duplex impedance shield 30 is comprised of a primary loop 32 which is located adjacent to and in surrounding relation to molten metal head 19 and inside inductor 11, and a secondary loop 36 located remote from the casting station area. Shield primary and secondary loops 32 and 36 are interconnected by a transition section 34. Transition section 34 is provided with insulation 37 to prevent shorting out of the overall loop of shield 30. (See FIG. 3). Insulation 37 might typically be constructed of a thermosetting high temperature plastic such as fiberglass reinforced phenolic or fiberglass reinforced silicone.

Shield 30 may be externally cooled by is preferably provided with hose nipples 38 for supplying a cooling liquid such as water to internal passages 33 within shield 30.

Shield 30 could be constructed of a tubular material. In such an instance it would be desirable to place a wall structure 39 at a location between hose nipples 38 to assist in ready circulation of the cooling liquid around shield 30.

In shielding, shield 30 acts as an electrical element absorbing current. The extent to which it absorbs current depends on its electrical impedance, (Z). Typically, the impedance of the shield 30 is made up of inductance (L) and resistance (R), with inductance (L) being the greater contributor. In accordance with this invention, shield 30 is made to behave as if a larger air gap exists between forming molten metal head 19 and shield 30 by placing secondary loop 36 on the shield. The effect of adding a secondary loop 36 is to automatically increase both the resistance (R) and the inductance (L) of the shield 30.

In accordance with one aspect of this invention it is preferred to provide a predominantly inductive or reactive secondary shield loop. Less power is consumed by increasing the inductance (L) than by increasing the resistance to accomplish an equivalent increase of shield impedance.

The reactive nature of the shield circuit provides more leverage or control of impedance by manipulating the inductance (L) rather than the resistance (R).

It is preferred to cool the shield 30 in operation because as the temperature of the shield rises the effect is to raise the resistance and thereby the impedance of the shield. Cooling could be carried out by passing a cooling fluid such as for example water through passages provided in the shield, by spraying the shield with such a cooling fluid, or by placing the secondary loop 36 of the shield in a non-conducting bath of for example oil.

Figure 3:
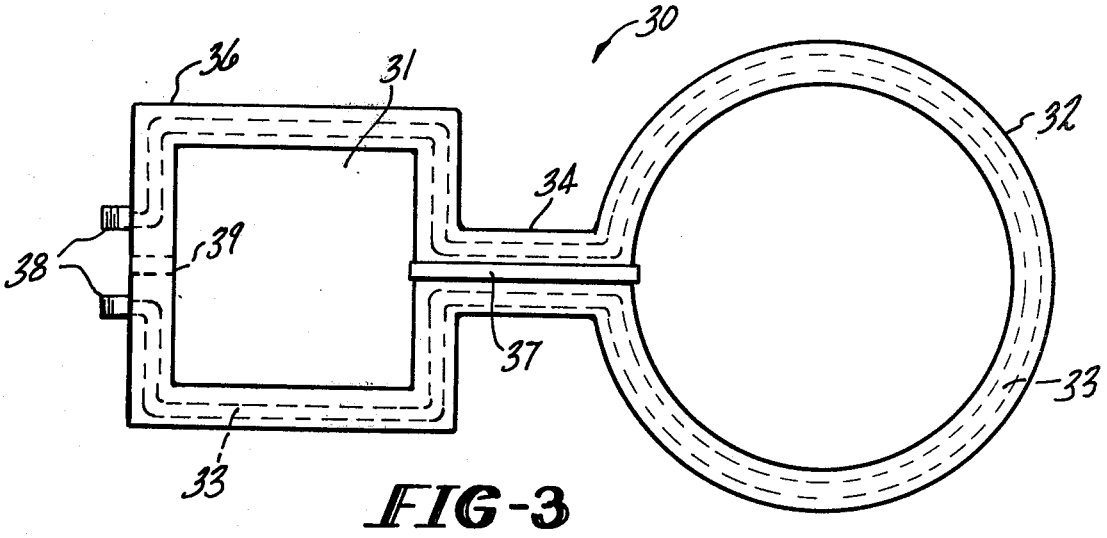
FIG. 3 is a top view of the duplex impedance shield depicted in FIG. 2.

As can be seen from FIGS. 2 and 3 the height h of shield 30 and/or the area 31 enclosed by the secondary loop could be varied to adjust the volume of air enclosed by shield 30.

Current frequencies typically used in electromagnetic casting range from 1 to 10 KHz. Shields utilized in electromagnetic casting must be semi-permeable in nature by virtue of their resistivity and thickness in order to provide attenuation rather than elimination of the magnetic field. Consequently stainless steel or a material of similar resistivity is typically used in the art. This material provides the required semi-permeable property when utilized in reasonable engineering dimension, for example in the order of 5 mm thick. In effect such shields are constructed of material of one penetration depth or less at the frequency of interest.

As discussed in U.S. Pat. No. 3,605,865 to Getselev it has previously been possible to construct shields out of low resistivity materials such as aluminum and copper only when utilizing such shields at low frequencies, for example between 50 to 500 Hz.

Table I indicates the approximate calculated values of the penetration depth $\delta$ for 304 stainless and copper at frequencies from 50 Hz to 100 KHz.

TABLE I

| Frequency | $\delta$Cu (mm) | $\beta$304 (mm) |
|---|---|---|
| 50 Hz | 9.2 | 60.0 |
| 500 Hz | 2.9 | 19.0 |
| 1 kHz | 2.1 | 13.4 |
| 3 kHz | 1.2 | 7.7 |
| 10 kHz | 0.7 | 4.2 |
| 100 kHz | 0.2 | 1.3 |

Calculated from $\delta = 500\ (\rho/f)^{\frac{1}{2}}$ meters
where $\rho$ = resistivity ($\Omega$m)
f = frequency (Hz)
$\rho Cu = 1.7 \times 10^{-8}\ \Omega m$
$\rho 304 = 72 \times 10^{-8}\ \Omega m$
$\delta Cu = 50\ (1.7/f)^{\frac{1}{2}} mm$
$304 = 50\ (72/f)^{\frac{1}{2}} mm$ As can be determined from Table I, the reason why prior to this invention copper could not be used at medium frequencies (1 to 10 KHz) was that it would be thin and flimsy at only 0.5 to 2 mm, quite unreasonable in an engineering (strength) sense. Stainless steel was much more practical with $\delta$ varying from 4 to 13 mm over this frequency range. At frequencies lower than 500 Hz copper is more practical with $\delta$ in the 3 to 9 mm range. Stainless steel would be of less value here since it is so transparent with $\delta$ in the 20 to 60 mm range.

In utilizing a secondary section or loop in accordance with this invention the inductance (L) of the shield is artificially increased permitting copper or aluminum shield in the medium frequency range of 1 to 10 KHz used in electromagnetic casting. Increased inductance (L) in the shield reduces the induced current in the shield (shielding current) making the copper or aluminum shield semi-permeable. Because the shield is now thicker (typically 3–10 mm), it is possible to utilize copper or aluminum without incurring severe engineering limitations. In the absence of a secondary loop, use of copper or aluminum thick enough to be of sufficient strength would provide too high a shielding current thereby totally shielding the molten metal head 19 from the inductor.

Use of low resistivity material such as copper as a shield material is highly desired since the resistivity of copper is considerably less than the resistivity of stainless steel for example, and thus the resistance of the shield is less. Lowering of shield resistance lowers the power loss of the system, i.e. real power dissipation would be lessened. In accordance with this invention the secondary loop 36 primarily increases the reactive load of the shield, and only slightly increases the resistive load. While it is contemplated to increase the shield impedance by increasing the resistance and/or inductance, it is nevertheless preferred to increase the shield inductance because of the lower cost.

It is of course possible to construct a shield out of more than one material, for example using a primary loop 32 constructed of stainless steel while utilizing a secondary loop 36 constructed of copper. Such a system would result in a power loss somewhat greater than that for a shield 30 completely constructed of copper, but under certain circumstances such a construction might be desirable.

Figure 6:
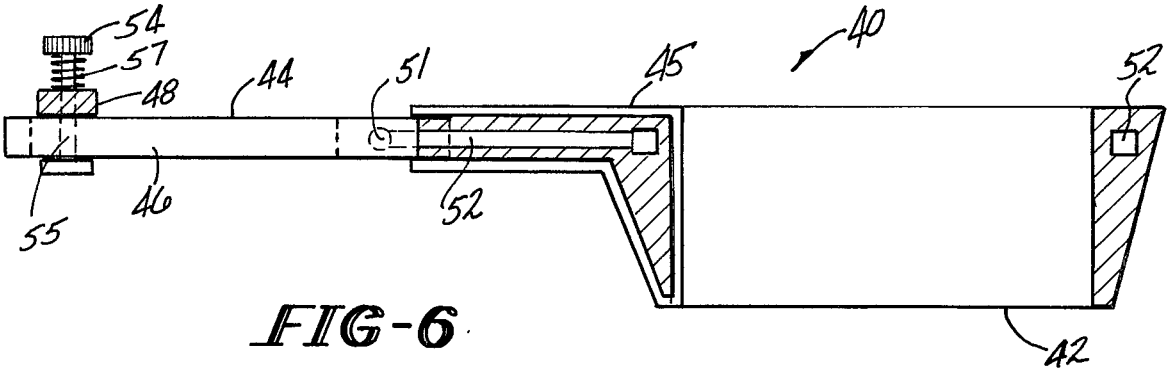
FIG. 6 is a cross section taken along the line 6—6 of FIG. 4 of the duplex variable impedance shield in FIG. 4.

In another embodiment of the present invention a duplex impedance shield is provided whose inductance and therefore impedance can be varied during electromagnetic casting to provide ingot shape control without moving the primary loop of the shield within the casting zone. The variable impedance of the shield is achieved by virtue of an adjustable shunt in the secondary loop which can be manipulated to vary the extent of the air gap enclosed by the shield, and hence its inductance, as indicated in FIGS. 4 and 6.

Figure 4:
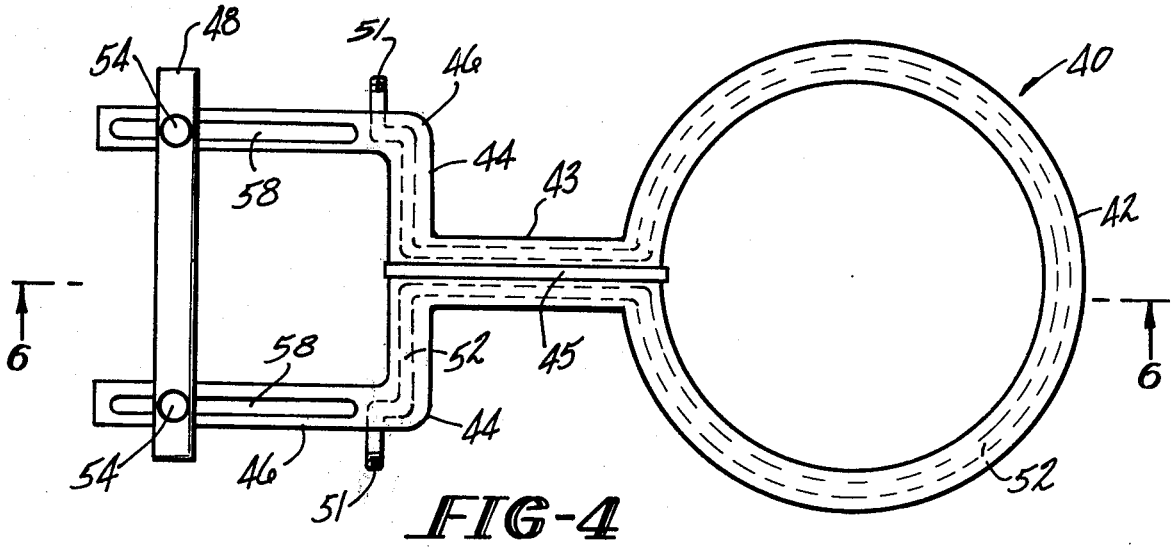
FIG. 4 is a top view of a duplex variable impedance shield in accordance with another embodiment of this invention showing a secondary shield portion formed by two legs and an adjustable shunt bar.
Figure 5:
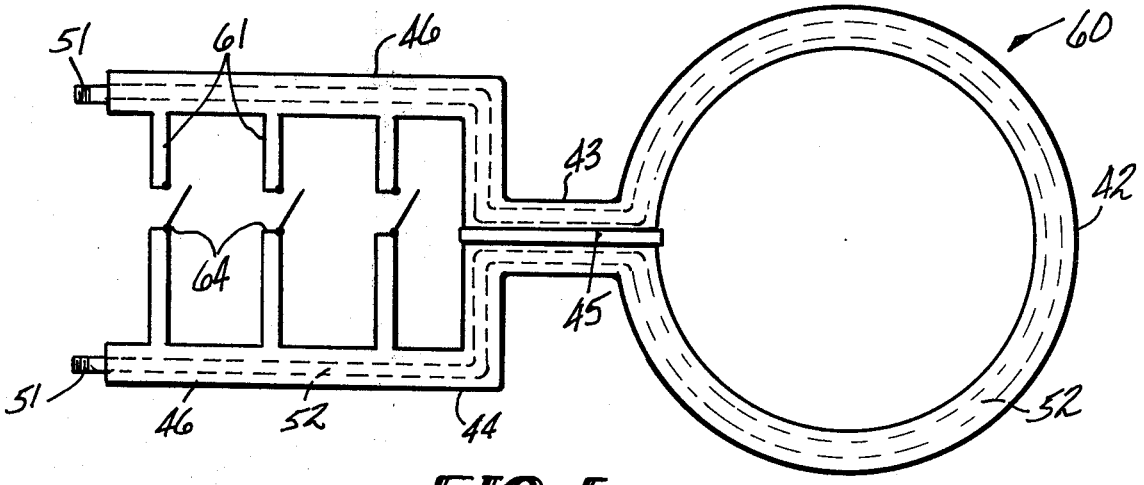
FIG. 5 is a top view of a duplex variable impedance shield in accordance with another embodiment of this invention showing a secondary shield portion formed by two legs and a multiplicity of fixed crossing shunt bars.

Referring to FIGS. 4 and 5 there is shown therein a duplex variable impedance shield 40 having a primary loop 42 and a secondary loop 44. Secondary loop 44 comprises two legs 46 and shunt bar 48 in spanning engagement therewith. Transition section 43 is provided with insulation 45 to prevent shorting of the overall shield loop. Hose nipples 51 are provided for supplying a cooling fluid to internal passages 52 which pass through portions of secondary loop 44 and primary loop 42.

Shunt bar 48 is maintained in firm engagement with legs 46 by control knobs 54 which are attached to through-pins 55. Good electrical contact is maintained between shunt bar 48 and legs 46 as a result of the pressure exerted by springs 57 against knobs 54 undersurface and the top surface of shunt bar 48. Retainers 56 of through-pins 55 prevent accidental removal of shunt bar 48 from crossing engagement with legs 46. Compression of knobs 54 enables ready adjustment of shunt bar 48 along legs 46 by sliding of through-pins 55 along slots 58. In this manner, the impedance of the shield 40 can be controlled and hence, the extent of its shielding action varied to obtain fine shape control.

Normally, in prior art electromagnetic casting processes the only way of utilizing shields to attenuate currents being induced in the molten metal head 19 was to move the shield vertically in the casting station. Utilization of the duplex variable impedance shield of FIGS. 4 and 6 enables variation of the impedance of shield 40 by permitting control of the air gap in the shield part of the containment apparatus without interfering with the other aspects of the electromagnetic casting process. The duplex variable impedance shield of this invention provides a primary shield loop of fixed geometry and location within and adjacent the casting zone, while utilizing a secondary loop located away from the casting zone to alter the circuit geometry and thus the air gap to yield a reflective change in shield inductance without moving the primary loop of the shield in the casting zone.

A duplex variable impedance shield 60 is depicted in FIG. 5 wherein a plurality of shunt bars can be individually activated as an alternative to adjusting of a single shunt bar. In this particular embodiment a plurality of shunt bars 61 project from the legs 46 of secondary loop 44. The impedance of the shield 60 can be varied by selectively throwing switches 64 thereby altering the air gap enclosed by shield 60. In all other respects shield 60 is the same as shield 40 shown in FIG. 4. If more than one switch 64 were closed the shortest closed circuit path would govern the impedance of shield 60.

Figure 7:
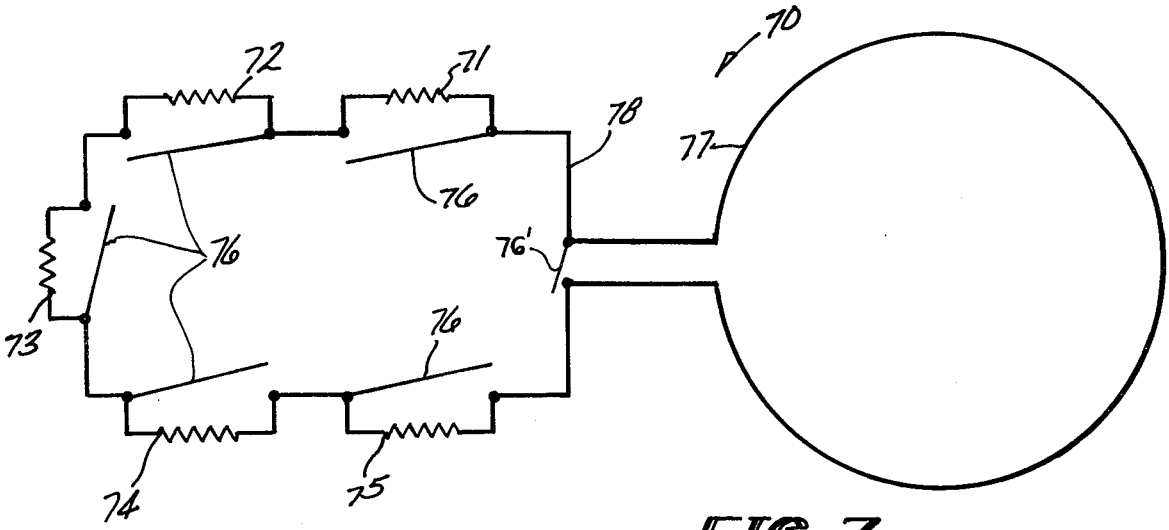
FIG. 7 is a schematic representation of a duplex variable impedance shield in accordance with another embodiment of this invention showing a secondary shield portion consisting of a series of individually shuntable resistors or resistive devices.

FIG. 7 is a schematic representation of another embodiment of a duplex variable impedance shield in accordance with this invention. As can be seen from FIG. 7 shield 70 is composed of primary loop 77 and secondary loop 78. Resistors 71, 72, 73, 74, and 75 are arranged in series about secondary loop 78 and can be selectively shunted by switches 76. The impedance of shield 70 is determined by the air gap enclosed by the primary and secondary loops 77 and 78 as well as by the resistance of the circuit. By selectively activating switches 76 resistors 71 through 75 can be included in the circuit in various combinations thereby varying the impedance of shield 70. The resistance of resistors 71 through 75 can be multiples of each other, the same, or variations of both. It is also contemplated that one or more of resistors 72 could be replaced by reactive coils.

Figure 8:
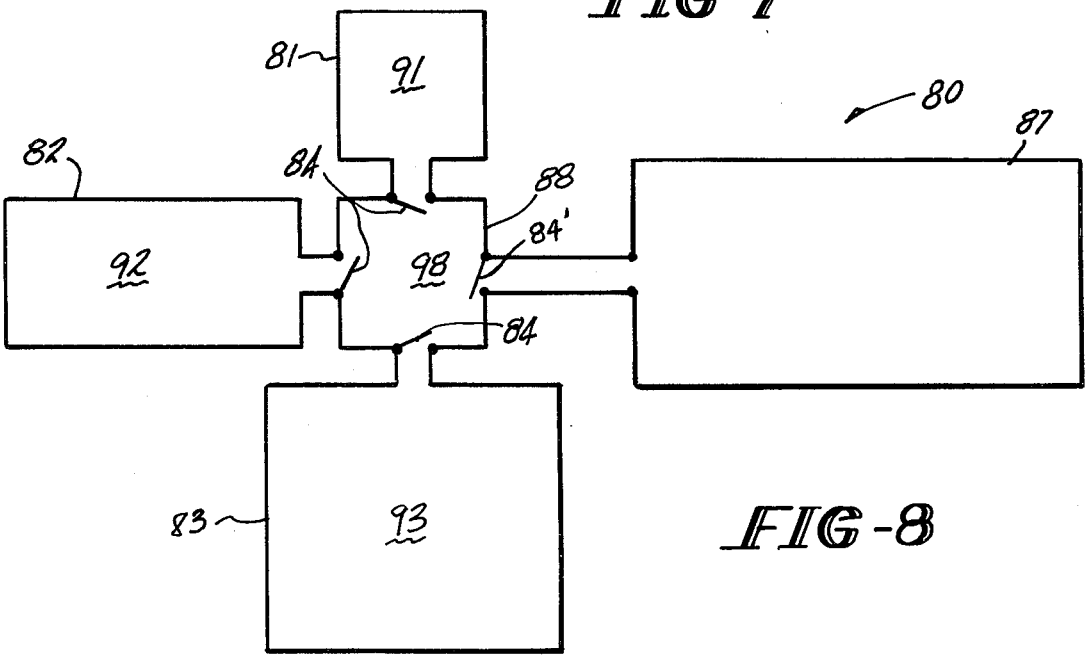
FIG. 8 is a schematic representation of a duplex variable impedance shield in accordance with another embodiment of this invention showing a secondary shield portion consisting of a series of individually shuntable auxiliary loops.

FIG. 8 is a schematic representation of yet another embodiment of a duplex variable impedance shield in accordance with this invention. As can be seen from FIG. 8 shield 80 is composed of primary loop 87 and secondary loop 88. Auxiliary loops 81, 82, and 83 are arranged in series about secondary loop 88 and can be selectively shunted by switches 84. The impedance of shield 80 can be varied by selectively activating switches 84 thereby varying the air gap enclosed by shield 80 and thus the impedance of shield 80. In a preferred embodiment the volumes of air designated 91, 92 and 93 enclosed by auxiliary loops 81, 82, and 83 respectively might typically be multiples of the volume of air 98 enclosed by secondary loop 88 when all the switches 84 are closed. Thus, the volume 91 would typically equal the volume 98, while volume 92 would be twice volume 91 and volume 93 would be three times volume 91.

FIGS. 7 and 8 also show bypass switches 76' and 84'. Use of such switches would enable bypassing of secondary loops 78 and 88 respectively, if it were desired to utilize only primary loops 77 and 87 during casting.

While the preferred embodiments of the shield of this invention have been depicted as having primary and secondary loops connected via a unified overall structure it is nevertheless clear that a secondary loop or means for varying the overall impedance of the shield could be attached to the primary loop be means such as brazing, welding, fastening, etc.

It is apparent that there has been provided in accordance with this invention an electromagnetic casting apparatus and process which fully satisfies the objects, means and advantages set forth hereinbefore. While the invention has been described in combination with specific embodiments thereof; it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A process for electromagnetically forming molten metal or alloy into cast ingots of desired shape comprising:

establishing a casting zone defining an upstream portion and a downstream portion;

placing an inductor in surrounding relation to said zone;

providing a duplex shield, said shield having a first loop defining a first impedance, and a second loop defining a second impedance connected to said first loop;

positioning said first loop adjacent to said inductor toward the upstream portion of said casting zone while positioning said second loop in spaced apart relation to said first loop, remote from said inductor and outside said casting zone;

passing a current through said inductor to generate an electromagnetic field in said casting zone;

pouring said molten metal or alloy into said casting zone; and attenuating said electromagnetic field with said duplex shield to provide desired ingot shape control during ingot solidification.

2. A process as in claim 1 wherein the current frequency during electromagnetic casting is in the range of 1 KHz to 10 KHz.

3. A process as in claim 2 wherein said duplex shield is formed of copper.

4. A process as in claim 2 wherein said duplex shield is formed of aluminum.

5. A process as in claim 1 wherein said duplex shield is made from at least two portions formed of different materials.

6. A process as in claim 1 including the step of passing cooling fluid through internal passages provided in the loops and connecting portion of said duplex shield.

7. A process as in claim 1 including the step of adjusting the impedance of said shield.

8. A process as in claim 7 including the steps of providing said second loop with means for adjusting the impedance of said second loop and therefore the overall impedance of said duplex shield.

9. A process as in claim 8 wherein said adjusting step is carried out prior to said step of pouring said molten metal or alloy.

10. A process as in claim 8 wherein said adjusting step is carried out during said steps of pouring and attenuating.

11. A process as in claim 8 wherein said step of providing a means for adjusting comprises providing said second loop with two legs and a movable shunt means in bridging engagement therewith, and said step of adjusting the overall impedance of said duplex shield comprises moving said shunt means to selected desired positions along said legs.

12. A process as in claim 8 wherein said step of providing a means for adjusting comprises providing said second loop with one or more selectively includable resistive devices, and said step of adjusting the overall impedance of said duplex shield comprises selectively including one or more of said resistive devices in said second loop.

13. A process as in claim 8 wherein said step of providing a means for adjusting comprises providing said second loop with one or more selectively includable auxiliary loops, and said step of adjusting the overall impedance of said duplex shield comprises selectively including one or more of said auxiliary loops in said second loop.

14. A process as in claim 8 wherein said step of providing a means for adjusting comprises providing said second loop with one or more selectively includable reactive coils, and said step of adjusting the overall impedance of said duplex shield comprises including one or of said reactive coils in said second loop.

15. A process as in claim 8 wherein said step of providing a means for adjusting comprises providing said second loop with two legs and a plurality of individually selectable shuntable shunt means in spanning relation therewith, and said step of adjusting the overall impedance of said duplex shield comprises selectively shunting one or more of said shunt means.

16. A process for electromagnetically forming molten metals or alloys into cast ingots of desired shape comprising pouring of said molten metal or alloy into a casting zone established by an inductor and at least a portion of a non-magnetic shield defining a first impedance, said inductor inducing an electromagnetic field in said casting zone and said shield attenuating said electromagnetic field, the improvement comprising:

providing a portion of said non-magnetic shield, remote from said inductor and outside said casting zone, defining a second impedance; and, adjusting the overall impedance of said shield during said casting process by selectively altering the impedance of said portion of said non-magnetic shield remote from said inductor and outside said casting zone.

17. An apparatus for electromagnetically forming molten metals or alloys into a casting of desired shape comprising means establishing a casting zone for receiving and electromagnetically forming said molten metal or alloy into said desired shape, said receiving and forming means including an inductor for generating a magnetic field, and means for attenuating said magnetic field, the improvement wherein:

said means for attenuating said magnetic field comprises a non-magnetic duplex shield, said duplex shield having a primary loop located adjacent to said inductor and within said casting zone defining a first impedance, and a secondary loop spaced apart from said primary loop remote from said inductor and outside said casting zone defining a second impedance, said secondary loop being connected to said primary loop whereby the overall impedance of said duplex shield is greater than said first impedance.

18. An apparatus as in claim 17 wherein said second portion comprises at least one resistor.

19. An apparatus as in claim 17 wherein said second portion comprises at least one reactive coil.

20. An apparatus as in claim 17 wherein said primary loop defines a first air space and said secondary loop defines a second air space.

21. An apparatus as in claim 20 wherein said secondary loop includes two legs and a movable shunt means in bridging engagement therewith whereby the impedance of said secondary loop and therefore the overall impedance of said shield can be varied by moving said shunt means along said legs.

22. An apparatus as in claim 21 wherein said shunt means comprises a shunt bar.

23. An apparatus as in claim 20 wherein said secondary loop includes selectively one or more resistive devices and means for selectively including said one or more resistive devices in said secondary loop whereby the impedance of said secondary loop and therefore the overall impedance of the shield can be varied by selectively including said devices in the shield circuit.

24. An apparatus as in claim 23 wherein said means for selectively including said resistive devices comprises switch means.

25. An apparatus as in claim 20 wherein said secondary loop includes selectively one or more auxiliary loops and means for selectively including said one or more auxiliary loops in said secondary loop whereby the impedance of said secondary loop and therefore the overall impedance of said shield can be varied by individually activating one or more of said auxiliary loops.

26. An apparatus as in claim 25 wherein said means for selectively including said auxiliary loops comprises swtich means.

27. An apparatus as in claim 20 wherein said secondary loop includes selectively one or more reactive coils and means for selectively including said one or more reactive coils in said secondary loop whereby the impedance of said secondary loop and therefore the overall impedance of the shield can be varied by selectively including said coils in the shield circuit.

28. An apparatus as in claim 27 wherein said means for selectively including said reactive coils comprises switch means.

29. An apparatus as in claim 20 wherein said secondary loop includes two legs and a plurality of individually selectively shuntable shunt means in spanning relation therewith whereby the impedance of said secondary loop and therefore the overall impedance of said shield can be varied by shunting a selected one or more of said shunt means.

30. An apparatus as in claim 17 wherein said shield is constructed of copper.

31. An apparatus as in claim 17 wherein said shield is constructed of aluminum.

32. An apparatus as in claim 17 wherein said shield is constructed of at least two different materials joined together.

33. An apparatus as in claim 20 wherein at least one of said primary and secondary loops is of greater thickness than said connecting portion.

34. An apparatus as in claim 20 wherein said primary and secondary loops are of greater thickness than said connecting portion.

35. An apparatus as in claim 17 wherein said shield is provided with internal passages for circulation of a cooling fluid therein.

36. An apparatus as in claim 20 wherein said primary and secondary loops and said connecting portion are provided with an interconnected internal passage for circulation of a cooling fluid therein.

37. An apparatus for electromagnetically forming molten metals or alloys into a casting of desired shape comprising means establishing an electromagnetic casting zone for receiving and electromagnetically forming said molten metal or alloy into said desired shape, including means, defining said casting zone, for generating a magnetic field and means having an impedance for attenuating said magnetic field, the improvement comprising:

said attenuating means having a first portion, located adjacent to said means for generating said magnetic field and within said casting zone, defining a first impedance; and, a second portion, remote from said casting zone, defining a second impedance and connected to said first portion of said attenuating means, said second portion being provided with means for varying said impedance of said attenuating means.

38. An apparatus as in claim 37 wherein said means remote from said casting zone includes at least one resistor.

39. An apparatus as in claim 37 wherein said means remote from said casting zone includes at least one reactive coil.

* * * * *

UNITED STATES PATENT AND TRADEMARK OFFICE

CERTIFICATE OF CORRECTION

PATENT NO. : 4,265,294

DATED : May 5, 1981

INVENTOR(S) : Gerhart K. Gaule, John C. Yarwood, Derek E. Tyler, and Ik Y. Yun

It is certified that error appears in the above-identified patent and that said Letters Patent is hereby corrected as shown below:

In the cover page, line 3, "DUFLEX" should read —DUPLEX—.

Column 1, line 2, "DUFLEX" should read —DUPLEX—.

Column 5, line 28, "by" should read —but—.

Column 6, TABLE I, in the third column, "β304" should read —δ304—;

Column 6, TABLE I, the seventh line of the footnotes, "304" should read —δ304—.

Column 8, line 52, "be" (second occurrence) should read —by—.

Column 10, line 3, the word —selectively— should be inserted after "comprises";

Column 10, line 4, the word —more— should be inserted after "or".

Signed and Sealed this

*Twenty-third* Day of *November 1982*

[SEAL]

*Attest:*

GERALD J. MOSSINGHOFF

*Attesting Officer*

*Commissioner of Patents and Trademarks*